US010077167B2

(12) United States Patent
Roivainen et al.

(10) Patent No.: US 10,077,167 B2
(45) Date of Patent: Sep. 18, 2018

(54) ELEVATOR CAR WITH SPOILER COMPONENT HAVING AT LEAST ONE CURVED SPOILER ELEMENT

(71) Applicants: Gabriela Roivainen, Hyvinkaa (FI); Iiro Heinonen, Hyvinkaa (FI); Ville Myyrylainen, Hyvinkaa (FI); Pekka Markkanen, Savonlinna (FI); Jaakko Kalliomaki, Vantaa (FI)

(72) Inventors: Gabriela Roivainen, Hyvinkaa (FI); Iiro Heinonen, Hyvinkaa (FI); Ville Myyrylainen, Hyvinkaa (FI); Pekka Markkanen, Savonlinna (FI); Jaakko Kalliomaki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 179 days.

(21) Appl. No.: 14/947,972

(22) Filed: Nov. 20, 2015

(65) Prior Publication Data

US 2016/0167925 A1 Jun. 16, 2016

(30) Foreign Application Priority Data

Dec. 11, 2014 (EP) ..... 14197399

(51) Int. Cl.
*B66B 11/02* (2006.01)

(52) U.S. Cl.
CPC ..... *B66B 11/0226* (2013.01)

(58) Field of Classification Search
CPC ..... B66B 11/0226
See application file for complete search history.

(56) References Cited

U.S. PATENT DOCUMENTS 849,357 A * 4/1907 Ballard ..... B66B 11/0226 187/313
4,411,121 A * 10/1983 Blacklin ..... E04C 2/08 52/630
5,115,621 A * 5/1992 Kobayashi ..... E04F 15/02429 52/630
5,220,979 A * 6/1993 Matsuda ..... B66B 11/0226 187/401
6,047,792 A * 4/2000 Jin ..... B66B 11/0206 187/401
7,665,583 B2 * 2/2010 Kuipers ..... B66B 11/0005 187/404

(Continued)

FOREIGN PATENT DOCUMENTS

CA 2280363 A1 2/2000
JP 2011079677 A 4/2011
WO WO-2011122179 A1 10/2011

OTHER PUBLICATIONS

JP2011079677_English_Translation.pdf.*
European Search Report for EP 14197399 dated May 27, 2015.

*Primary Examiner* — Minh Truong
(74) *Attorney, Agent, or Firm* — Harness, Dickey & Pierce, PLC

(57) ABSTRACT

The invention relates to an elevator car comprising a car spoiler at its top and/or bottom, which car spoiler comprises at least one spoiler component having at least one curved spoiler element, characterized in that the spoiler component is made of a sandwich material of an outer flat material layer connected to at least one inner structured material layer.

15 Claims, 6 Drawing Sheets

(56) References Cited

U.S. PATENT DOCUMENTS

Figure 1:
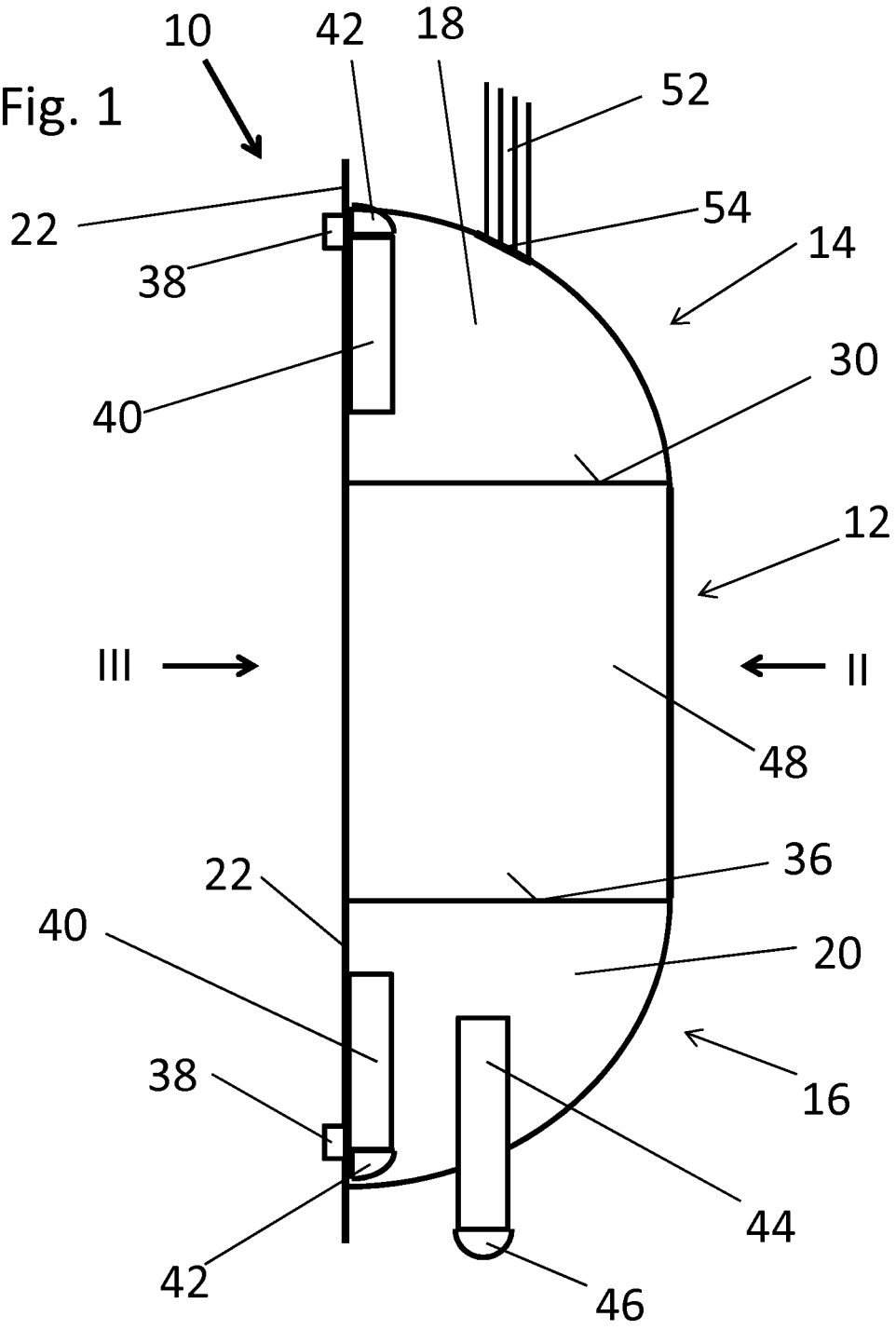

| | | | | |
|---|---|---|---|---|
| 2006/0289242 | A1* | 12/2006 | Oberer | B66B 11/0226 187/333 |
| 2010/0116597 | A1* | 5/2010 | Matsuda | B66B 11/0226 187/401 |
| 2013/0098713 | A1* | 4/2013 | Urben | B66B 11/0226 187/401 |

* cited by examiner

70

72
78
74,76
Vb
82,84
80
86
74
72
78
76
Va
84
82
80
86

ELEVATOR CAR WITH SPOILER COMPONENT HAVING AT LEAST ONE CURVED SPOILER ELEMENT

This application claims priority to European Patent Application No. EP1417399.0 filed on Dec. 11, 2014, the entire contents of which are incorporated herein by reference.

The present application refers to an elevator car having a car spoiler at its top and/or bottom with at least one spoiler component comprising a curved spoiler element. The curved shape of the spoiler element essentially reduces the air resistance of the elevator car which is beneficial particularly for fast driving elevators. Another essential advantage of elevator cars having car spoilers is the reduction of the noise when the elevator car travels in an elevator shaft with its nominal travel velocity. Anyway, if the car spoilers are poorly fixed or have a discontinuous shape vibrations may occur which again could increase the noise level.

It is therefore object of the invention to provide an elevator car having a top and/or bottom spoiler which is safe and reduces noise when travelling in an elevator shaft.

The object is solved with an elevator car. Embodiments of the invention are also shown in the description and in the drawings. The inventive content may also consist of several separate inventions, especially if the invention is considered in the light of explicit or implicit subtasks or with respect to advantages achieved. In this case, some of the attributes contained in the claims below may be superfluous from the point of view of separate inventive concepts. The features of different embodiments of the invention can be applied in connection with other embodiments within the scope of the basic inventive concept.

According to the invention, the car spoiler comprises at least one spoiler component having at least one curved spoiler element. The at least one spoiler component is made of a sandwich material having at least one outer flat material layer connected to at least one inner structured material layer. The outer flat material layer leads to a reduction of the air resistance of the spoiler component at the side facing the elevator shaft and the inner structured material layer leads to an improvement of the rigidity of the spoiler component and thus gives the desired rigidity which also leads to a noise reduction because of reduced vibrations of the spoiler component during the travel of the elevator car.

Preferably, between the material layers a noise insulating material may be located. Of course, the sandwich material may also consist of more than two layers, e.g. from one inner structured layer and one flat material layer on each side thereof.

It is hereby to be mentioned that in the sandwich material of the spoiler component comprising the flat outer layer as well as the inner structured layer have each a high rigidity and are thus preferably made from metal, particularly aluminum, or reinforced plastics. This applies for the spoiler element as well as for the spoiler plate and preferably all other spoiler components. The connection of the spoiler element and the spoiler plate can then easily be performed by welding or gluing or even by connecting the parts via screw bolts. In this case, the spoiler component has flange parts to be connected to other spoiler components, parts thereof or to the elevator car.

In one preferred embodiment of the invention the sandwich material comprises a at least three layers with two outer flat layers and an inner structured layer in between. Such a sandwich material can be made very rigid and lightweight and has good noise insulation properties.

Preferably, the inner structured layer is a honeycomb structure with the axis of the honeycomb cells perpendicular to the plane of the sandwich material. This leads to an extremely rigid lightweight material for the spoiler components.

In a preferred embodiment of the invention the spoiler component comprises at least one vertically extending spoiler plate on one side of the elevator car, which spoiler plate is connected with the spoiler element.

The spoiler plate is thereby located preferably in the door region of the elevator car. Via this spoiler element, the wind is kept away from the door region which reduces the noise generated during the travel of the elevator car in the shaft, particularly in the door region which is susceptible for air turbulences during the car travel. Furthermore, the connection of the spoiler plate with the spoiler element leads to a rigid spoiler construction which reduces noise as the car spoiler consisting of the connected spoiler element and spoiler plate is less susceptible to vibrations.

The spoiler plate preferably exceeds the curved spoiler element, i.e. it extends above the spoiler element in the car top or extends below the spoiler element in the car bottom. The use of a such spoiler plate exceeding the curved spoiler element is advantageous because in this case the wind is by the spoiler plate prevented from entering the gap between the spoiler plate side of the elevator car and the adjacent shaft wall. As this side is usually the landing door side, this arrangement leads to an essential reduction of the noise.

Preferably, the spoiler plate is a rectangular plate which is easy to produce with reasonable costs. Of course, the spoiler plate may also have a curved top edge, to reduce the air resistance.

In an advantageous embodiment of the invention, the spoiler plate has a door or hatch to the space between the spoiler element and the car roof. Via this measure, the area or space between the spoiler element and the car roof or the car bottom and the spoiler element is accessible for maintenance or emergency purposes. Preferably, the hatch or door is configured to be opened from the space between the car roof and the spoiler element in which case this hatch and door can also be used as an escape opening for passengers trapped in the elevator car. Preferably, the hatch or door can also be opened from the outside so that advantageously the hatch or door in the spoiler plate can be opened from the space between the car roof and the spoiler element as well as from outside. The same holds true for the area between the car bottom and the spoiler element.

The top emergency hatch located on the top of the top spoiler is different from the hatch located in the front spoiler plate. That one can be accessed from the shaft, if the elevator stops between floors and we cannot access the front hatch. There the fireman can come in and access the rescue door from the car wall and save the passengers. The top emergency hatch is preferably fixed with a preferably coated chain to the elevator car. The other front hatches preferably have no chain, because it would be in the way. Any of the front hatches are opened only when the spoiler is in front of landing doors for maintenance use.

Preferably, the hatch or door is fixed to the elevator car with a chain or rope so that the hatch or door does not fall into the elevator shaft when it is opened. Via this measure, the danger of people in the elevator shaft being injured is essentially reduced.

In one preferred embodiment of the invention, two spoiler plates are located at opposite sides of the elevator car and the curved spoiler element is connected to both of said plates. Via this measure, a roof type configuration of the top or bottom spoiler of the elevator car is obtained whereby the wind is by the spoiler plates prevented from entering the sides of the elevator shaft wall which face the spoiler plates. Via the, particularly symmetrically, curved spoiler element the air is guided to the two remaining sides of the elevator car. This arrangement is particularly useful when doors are provided on opposite sides in the elevator car. As in this case the spoiler element has only to be curved around one axis, the production of such a spoiler element is cheaper than in a case where a bending or forming of the spoiler element has to be provided around several axes.

In a preferred embodiment of the invention, the spoiler plate extends from the car top to the car bottom in which the car side on which the spoiler plate is located is completely vertical and smooth and thus offers low air resistance and reduced turbulences between the shaft wall and the corresponding side of the elevator car during the travel of the elevator car. Of course, in this case the spoiler plate does not necessarily be made from one part but it can also be made from several parts, particularly parts which are located in vertical direction one above the other and are preferably aligned to each other so that there are no edges provided between the parts of the spoiler plates appear.

In one embodiment, the spoiler plate is preferably located at the side of the car door of the elevator car and thus has an opening corresponding to the car door opening of the elevator car. Via this measure, the complete car door side of the elevator car forms a smooth surface except the car door itself. In this case, preferably the door leafs of the car door are located with only a small offset behind the plane of the spoiler plate so that the edges between the car door and the spoiler plate are small so that no essential turbulences are created by them during the travel of the elevator car.

In a preferred embodiment of the invention, the elevator car comprises a spoiler lining which extends along at least one side wall of the elevator car which spoiler lining is aligned with the spoiler component. Via this measure, it is achieved that the connection between the spoiler component and the spoiler lining at the sides of the elevator car is realized without any interruptions or edges so that turbulences between the car spoilers at the top and/or bottom and the spoiler lining is reduced which essentially reduces the noise during the travel of the elevator car. The spoiler lining insulates the elevator car and additionally provides a flat smooth surface reducing noise during travel.

Preferably, also the spoiler lining of the elevator car is made from the same sandwich material as the spoiler component(s). Thus also the spoiler lining has the same advantageous rigidity and noise reducing properties as the spoiler component(s). The spoiler lining can advantageously also be provided with a noise insulating material to reduce the noise level in the elevator car.

Preferably, the spoiler component is fixed to the car structure and not to the car sling. As often the car sling transmits noise from the elevator drive, e.g. via the suspension ropes of the elevator car, the spoiler component, e.g. the spoiler element and the spoiler plate, is/are acoustically decoupled from the car sling. This also improves noise reduction. Accordingly, the spoiler component is not in contact with the car sling which means it has no direct contact but is acoustically decoupled.

In a preferred embodiment of the invention, the spoiler element carries a rope collector which is mounted thereto. The rope collector is preferably aligned with the outer surface of the spoiler element. Via this measure, the rope collector is easily accessible from the outside and the air resistance in the area of the hoisting the suspension ropes going through the upper car spoiler is designed with a very low air resistance which reduces noise during travel.

Of course, from the car top and/or the car bottom, constructional components of the elevator car may extend as e.g. the supports of the guide elements and safety gears. Particularly, these supports are also provided with a corresponding spoiler.

Preferably, also the bottom buffer extensions of the elevator car are provided with a curved buffer spoiler which may be made of resilient material as to increase the dampening behavior if the buffer extension hits the buffer at the shaft pit.

Preferably, the elevator car comprises lifting means which enables a maintenance person to move the car spoiler away from the car top and/or from the car bottom. Such a lifting means can e.g. be hydraulic lifting means on the car top as well as a winch or the like at the car bottom.

In a preferred embodiment of the invention the the inner structured layer is a flat layer having cup—or callot extensions directed to the first layer, whereby the first and second layer are extending in a distance from each other and are only connected at the cups or callots. This sandwich arrangement with air in between has a great rigidity as well as noise insulation, which is caused by the two layers only be connected in the cup or callot like extensions. The extensions preferably have a circular cross-section but can also have a polygonal, elliptical or other shape, e.g. star-like. The area ratio between area where the layers are separated and where the layers are connected shall advantageously be larger than 3:1, better 5:1. The higher the ratio, the better the noise isolation. On the other hand the ratio must not be too high to maintain a desired rigidity of the sandwich material.

Of course, the present invention also relates to an elevator comprising at least one elevator car according to above specifications.

For the skilled person it is clear that single components of the claims can be provided as single component or as multiple components.

It is further clear for the skilled person that a single component may be provided as a one piece part or as a component made from several parts. Thus, the spoiler plate may consist of one single plate or may be mounted by connecting smaller plates together. Correspondingly, the spoiler element may consist of one or several parts.

Any connecting elements between components of the car spoiler or parts thereof, e.g. between the spoiler element and the spoiler plate, shall be accessible from the outside or from the inside to facilitate the mounting and demounting of the car spoiler to the elevator car.

Preferably, the spoiler components of the top car spoiler and the middle spoiler(s) are connected to the elevator car and to each other with fixings and screws which are arranged at the inner side of the spoiler components facing the elevator car. Via this measure a safer and reliable connection and disconnection of the corresponding spoiler components is possible. The bottom car spoiler is preferably installed from the shaft.

Preferably, the top spoiler is fixed with brackets and T-bolts whereas the middle and bottom spoilers and their walls are fixed with screws and rivet nuts.

The invention is now described schematically in the enclosed drawings.

Figure 2:
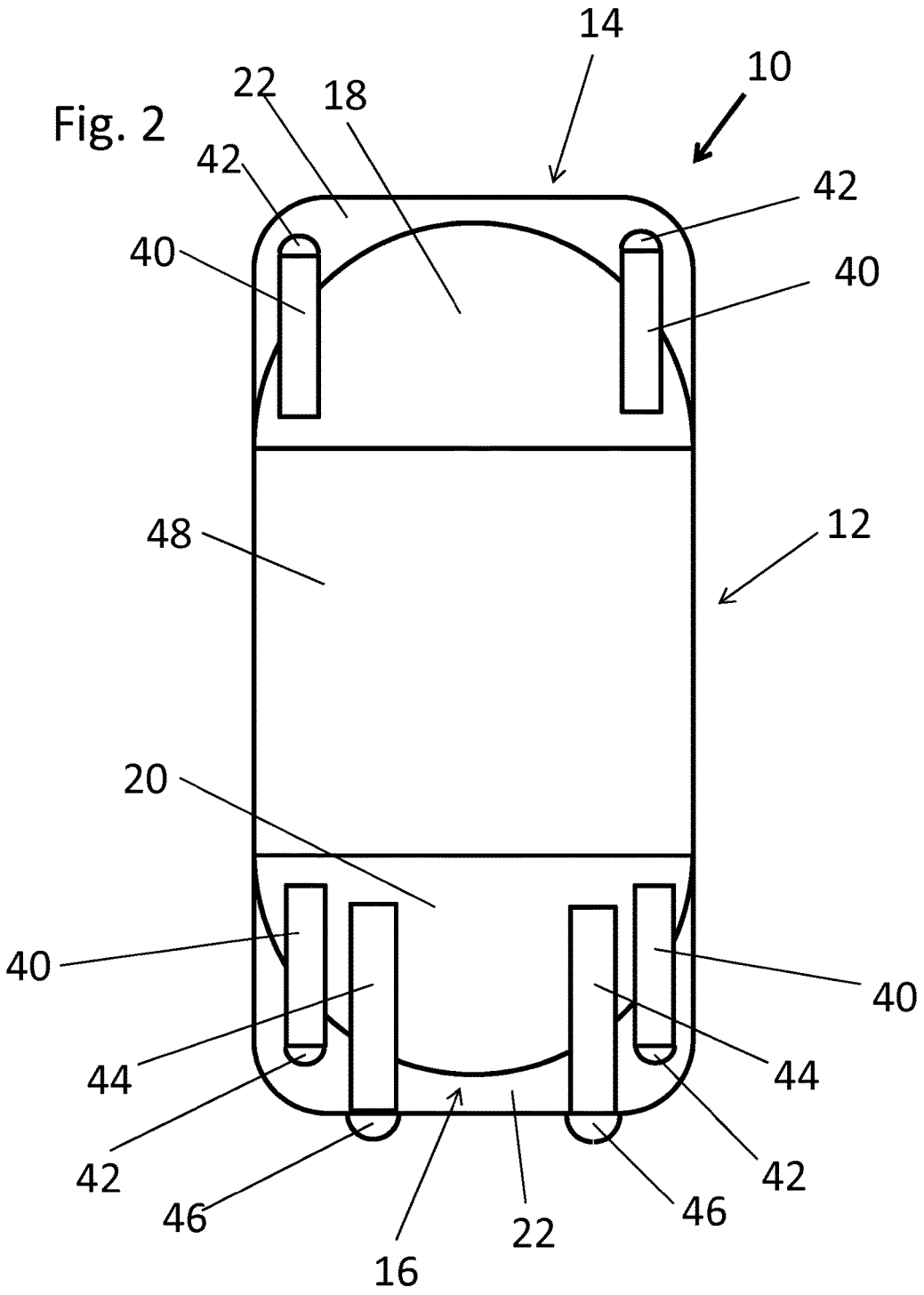
Figure 3:
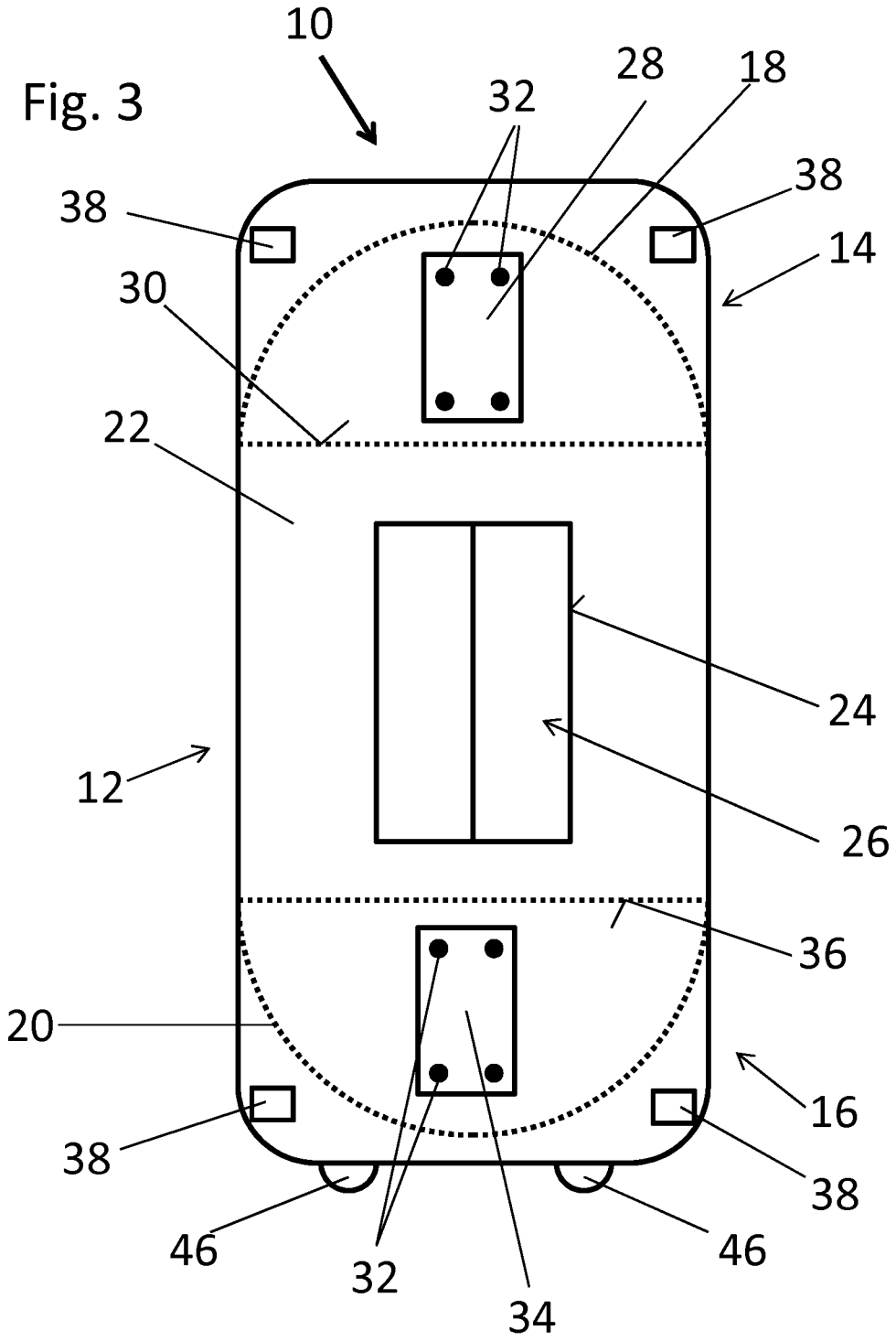
Figure 4A:
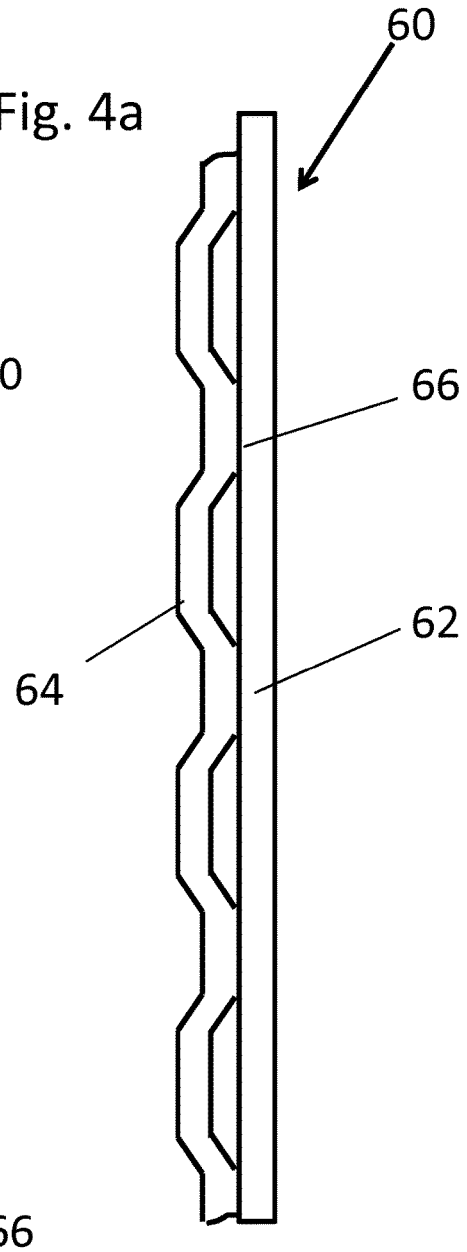
Figure 4B:
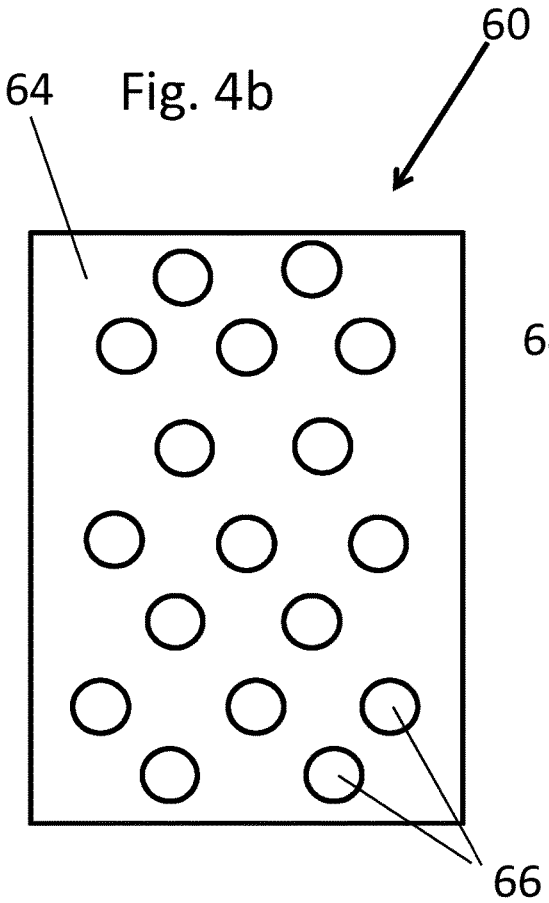
Figures 5A, 5B:
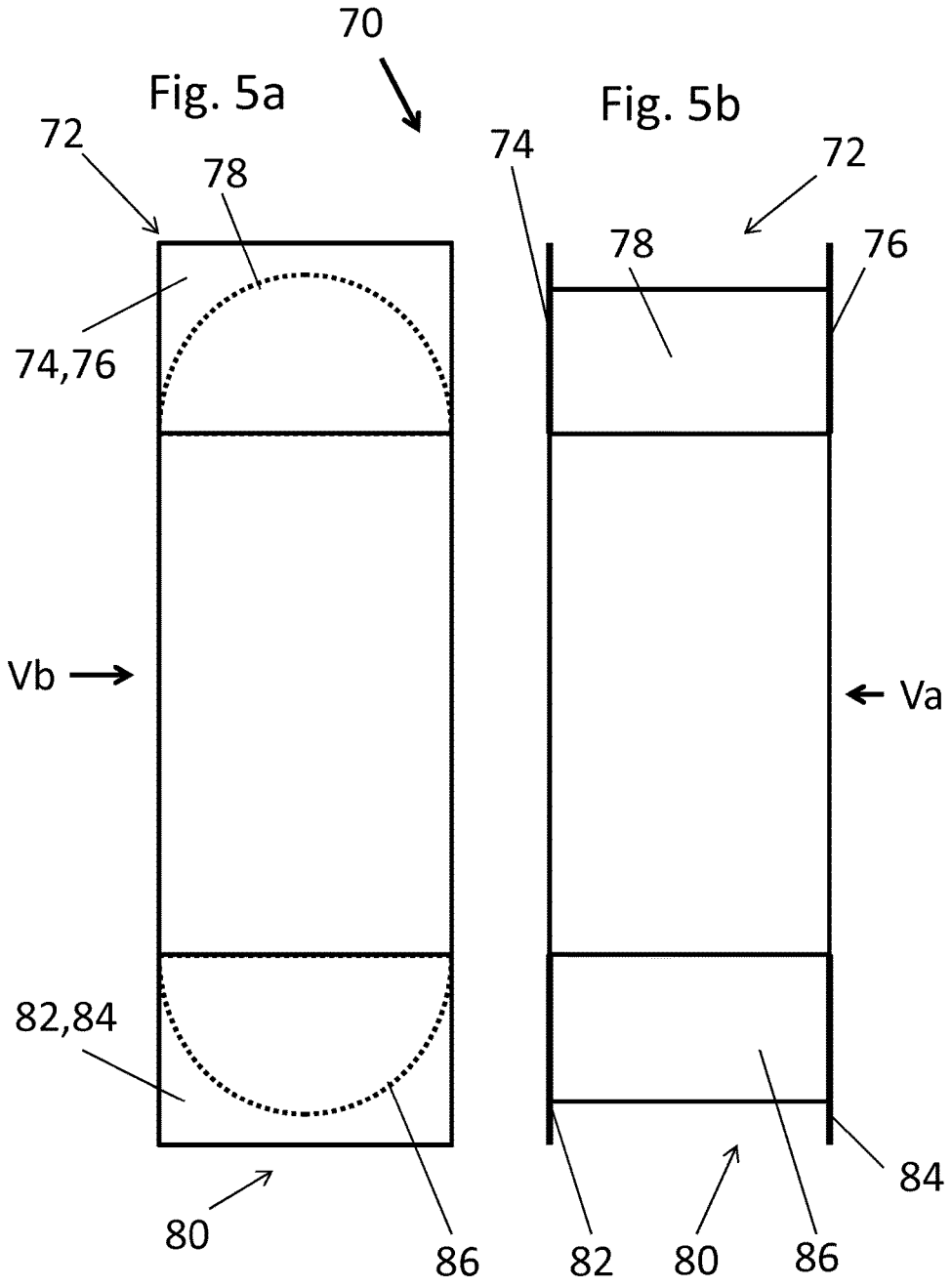
Figure 6:
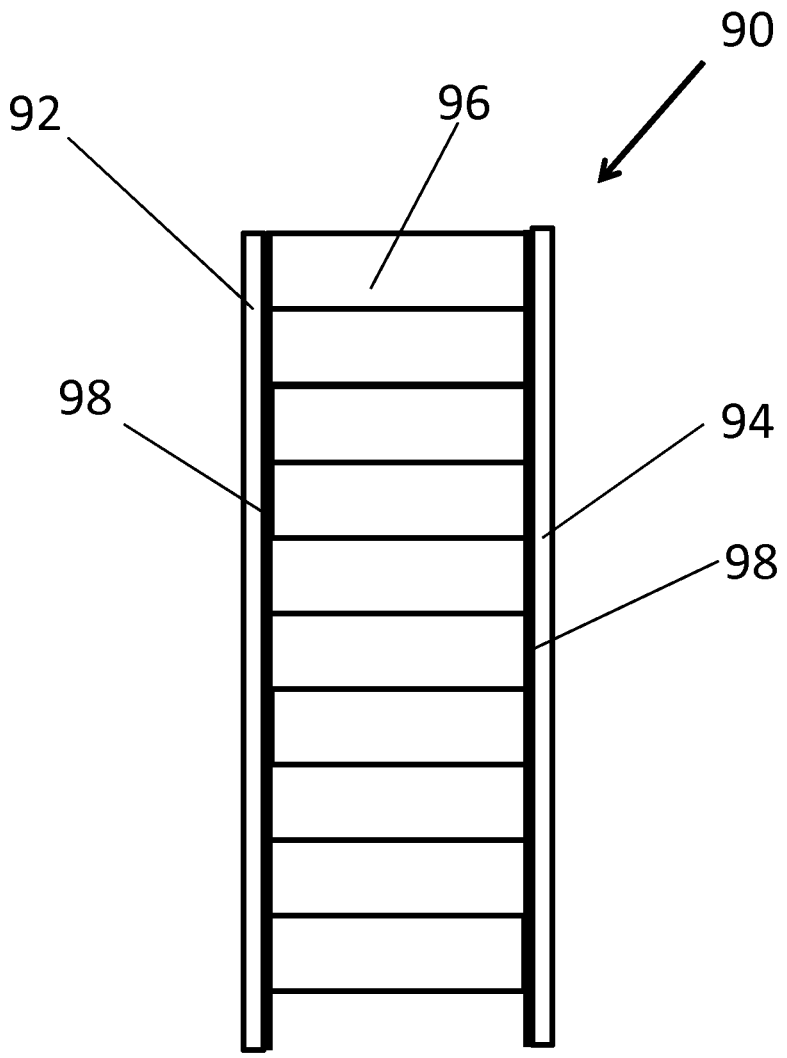

FIG. 1 shows a side view of an elevator car having a top car spoiler and a bottom car spoiler, FIG. 2 shows the side view II from FIG. 1, FIG. 3 shows the side view III of FIG. 1, FIG. 4*a* shows a section through the material of the spoiler element and spoiler plate, FIG. 4*b* shows a front view of the material of FIG. 4*a* from the structured layer side, FIG. 5*a*/5*b* shows a second embodiment of an elevator car with two opposite spoiler plates and a spoiler element in between for the top car spoiler and bottom car spoiler, and FIG. 6 shows a section through a sandwich material for the spoiler components with a honeycomb structure between two flat layers.

FIG. 1 shows an elevator car 10 having a car frame 12 to which a top car spoiler 14 and a bottom car spoiler 16 are mounted. The top car spoiler 14 and the bottom car spoiler are made of a sandwich material as shown in FIG. 4. Each spoiler 14,16 consists of two spoiler components, i.e. of a curved spoiler element 18, 20 and a vertical spoiler plate 22 to which the spoiler elements 18, 20 are connected. The spoiler plate 22 extends from above the upper spoiler element 18 to below the lower spoiler element 20 whereby the connection between the spoiler elements 18, 20 and the corresponding spoiler plate 22 is preferably performed by gluing, welding or by other connection techniques as e.g. screw bolts or rivets. The spoiler plate 22 covers the complete car door side of the elevator car 10 which therefore provides a smooth surface there. As it may be seen from FIG. 3, the spoiler plate 22 has an opening 24 for the landing door 26 of the elevator car. Furthermore, the spoiler plate 22 comprises an upper hatch 28 which is located in the spoiler plate 22 below the upper spoiler element 18 and above the car top 30. The upper hatch 28 is fixed to the spoiler plate 22 via fixings 32 which can be opened from within the space between the spoiler element 18 and the car roof 30 as well as from outside. The upper hatch 28 is preferably connected to the spoiler plate 22 or another structure of the elevator car with a joint, a wire or a chain to prevent the falling down of the upper hatch 28 when it is removed.

An additional emergency hatch may be provided in the upper car spoiler 14 which is different from the shown maintenance hatches 28 and 34.

In a corresponding manner, a lower hatch 34 is located in the spoiler plate 22 between the car bottom 36 and the lower spoiler element 20. Also the lower hatch 34 is connected with fixings 32 to the spoiler plate 22 which can be opened from within the space between the lower spoiler element 20 and the car bottom 36 as well as from outside. The guide rollers and safety gears 38 are located at vertical supports 40 which extend from the car top as well as from the car bottom and protrude the upper and lower spoiler element 18, 20. The free ends of the supports 40 are also provided with support spoilers 42. This arrangement holds true for a rucksack type elevator. The supports 40 can also be located at other places according to the arrangement of the car guide rails in the elevator shaft. The guide rollers and safety gears 38 protrude in this embodiment e.g. through openings in the spoiler plate 22 (in case of a rucksack type elevator).

The elevator car has furthermore two buffer extensions 44 extending downwards from the car bottom 36 through the lower spoiler element 20. Also the buffer extensions 44 are provided at their lower ends with buffer spoilers 46.

The upper spoiler element 18 and the lower spoiler element 20 are curved in a kind of parabolic shape. A vertical spoiler lining 48 is provided preferably at each car side except the side of the car doors where the spoiler plate 22 is located. The spoiler lining 48 is connected to the upper spoiler element 18 and the lower spoiler element 20 preferably without any protruding or recessing edge so that no turbulences occur at these connecting edges 50. At the upper side of the elevator car 10, the suspension ropes 52 via which the elevator car 10 is suspended in an elevator shaft enter a rope collector 54 which is aligned with the surface of the upper spoiler element 18. The same may hold true with lower compensation ropes (not shown) which would then protrude through the lower spoiler element 20. The upper spoiler element 18, the lower spoiler element 20 as well as the spoiler plate 22 and preferably also the spoiler lining 48 which is arranged at the three car sides except the landing door side may preferably consist of the same sandwich structure comprising a flat or planar outer material layer connected to an inner structured material layer. Whereas the flat material layer which faces to the elevator shaft leads to a low air resistance and a low noise, the structured material on the side of the spoiler elements and spoiler plate facing the car increases the stability and rigidity of the corresponding spoiler part and thus leads to reduction of vibrations and to more safety.

A sandwich structure of the material of the spoiler elements 18, 20 and the spoiler plate 22 is shown in FIGS. 4*a* and 4*b*.

The sandwich material 60 for the spoiler components 18, 20, 22 consists of an outer flat material layer 62, e.g. plate made of aluminum or plastics, connected at preferably callot or cup formed connecting regions 66 to an inner structured layer 64 which two layers 62, 64 are connected in the connecting regions 66 via welding, gluing or the like. The inner layer 64 is preferably a structured plate having cup-like, callot-like or groove-like extensions in the direction of the first flat layer. The extensions 66 form connecting regions to the outer flat material layer 62 providing a strong rigidity to the sandwich material 60. The connections can be made by gluing or welding or the like. The layers 62, 64 can be made of aluminum or plastics. The outer flat layer 62 is directed to the elevator shaft and the structured inner layer 64 is facing to the elevator car and provides the required rigidity of the spoiler component material. Between the layers a noise insulating material or simply air can be enclosed. The connecting regions 66 are preferably cup or callot like as this provides the best compromise of noise insulation and rigidity.

Finally, FIGS. 5*a* and *b* show another embodiment of an elevator car 70 having a top car spoiler 72 and a bottom car spoiler 80. The upper car spoiler 72 comprises two spoiler plates 74, 76 located at two opposite sides of the elevator car 70 and a cylindrical spoiler element 78 in between so that the top car spoiler forms a kind of roof-like structure. Similarly, the elevator car 70 comprises at its bottom a bottom car spoiler 80 having two spoiler plates 82, 84 at the same opposite sides of the elevator car as the two spoiler plates 74, 76 of the upper car spoiler and a curved half cylindrical spoiler element 86 in between (like the upper spoiler element 78). Of course, the orientation of the two half-cylindrical spoiler elements 78, 86 of the upper car spoiler 72 and the lower car spoiler 80 may also be offset horizontally by 90°. At the car sides where the two spoiler plates 74, 76 are located, preferably the car doors of the elevator car 70 are provided. The spoiler plates preferably extend from the top car spoiler 72 to the bottom car spoiler 80, although this is not necessary.

FIGS. 5*a* and 5*b* show two side views of the elevator car at viewing angles differing horizontally by 90°.

FIG. 6 shows a sandwich material 90 for a spoiler component 18, 20, 22, 48 comprising two outer layers 92, 94 which are glued with glue layers 98 to a honeycomb structure 96 in between. The outer layers 92, 94 preferably consist of aluminum with a thickness of preferably between 1 and 2 mm. The same holds true for the honeycomb structure in between. The hexagonal cells of the honeycomb structures are preferably oriented perpendicular to the plane of the sandwich material 90. The sandwich material 90 which may build spoiler plates or spoiler lining 48 aside of the elevator cabin could preferably also build the cabin walls because of their high rigidity. The cells must not be hexagonal but could also be square or different polygonal although hexagonal is preferred for rigidity reasons.

The invention is not restricted to the above-mentioned embodiments but can vary within the scope of the appended patent claims.

The invention claimed is:

1. An elevator car comprising:

a car frame; and a car spoiler at at least one end of a top of the car frame and a bottom of the car frame, the car spoiler including at least one spoiler component having at least one curved spoiler element, the at least one spoiler component including a sandwich material of an outer flat material layer connected to at least one inner structured material layer, wherein the at least one spoiler component includes at least one vertically extending spoiler plate on one side of the elevator car, the at least one spoiler plate connected with the at least one curved spoiler element, wherein the at least one spoiler plate includes a hatch to a space between the at least one curved spoiler element and a roof of the car frame, wherein the hatch is configured to be opened at least from the space between the at least one curved spoiler element and the roof of the car frame, and the hatch is fixed to the elevator car with a chain or rope when the hatch is removed from the at least one spoiler plate.

2. The elevator car according to claim 1, wherein the sandwich material comprises at least three layers with two outer flat material layers and an inner structured layer in between.

3. The elevator car according to claim 2, wherein the inner structured material layer is a honeycomb structure having honeycomb cells, and an axis of the honeycomb cells is perpendicular to a plane of the sandwich material.

4. The elevator car according to claim 1, wherein the at least one spoiler plate extends beyond the at least one curved spoiler element in relation to the car frame.

5. The elevator car according to claim 1, wherein the at least one curved spoiler element is connected to the at least one spoiler plate at one side of the elevator car.

6. The elevator car according to claim 5, wherein the at least one spoiler plate extends in line with one side face of the elevator car.

7. The elevator car according to claim 6, wherein the at least one spoiler plate extends from the top of the car frame to the bottom of the car frame.

8. The elevator car according to claim 5, wherein the inner structured material layer is a flat layer having cup extensions or callot extensions directed to a first layer, whereby the first layer and a second layer extend in a distance from each other and are only connected at the cup extensions or callot extensions.

9. The elevator car according to claim 1, wherein the at least one spoiler component is fixed to the car frame.

10. The elevator car according to claim 1, wherein the at least one curved spoiler element includes a rope collector mounted thereto which is aligned with an outer surface of the at least one curved spoiler element.

11. The elevator car according to claim 1, further comprising:

car rollers configured to guide the elevator car along one or more guide rails, the car rollers covered with roller spoilers extending away from the elevator car.

12. The elevator car according to claim 1, wherein the outer flat material layer and the inner structured material layer of the sandwich material of the at least one spoiler component include aluminum or plastics.

13. The elevator car according to claim 1, wherein the at least one spoiler component is connected to the elevator car with fixings and screws which are arranged at an inner side of the at least one spoiler component, the inner side facing the car frame.

14. The elevator car according to claim 1, comprising a spoiler lining along at least one side wall of the elevator car, the spoiler lining aligned with the spoiler component.

15. An elevator including at least one elevator car according to claim 1 configured to run in an elevator shaft.

* * * * *